United States Patent [19]

Randpalu

[11] 3,966,106

[45] June 29, 1976

[54] FOLLOWER ROLL SUSPENSION SYSTEM

[75] Inventor: Adu Randpalu, Lasalle, Canada

[73] Assignee: Dominion Engineering Works, Limited, Lachine, Canada

[22] Filed: July 24, 1974

[21] Appl. No.: 491,231

[52] U.S. Cl. ..... 226/42; 226/44; 226/194; 226/195

[51] Int. Cl.[2] ..... B65H 25/04

[58] Field of Search ..... 226/24, 25, 42, 43, 226/44, 190, 194, 195

[56] References Cited

UNITED STATES PATENTS

| | | | |
|---|---|---|---|
| 2,544,467 | 3/1951 | Michel | 226/44 X |
| 3,206,961 | 9/1965 | Bailey | 226/44 X |
| 3,718,269 | 2/1973 | Glaettli | 226/35 X |
| 3,807,613 | 4/1974 | Holm | 226/44 X |

*Primary Examiner*—Richard A. Schacher
*Attorney, Agent, or Firm*—R. A. Eckersley

[57] ABSTRACT

A follower roll or so-called spring roll system for use with a paper machine has a roll about which the paper web passes on its path through the machine, the web having a wrap angle about the roll of about 90°, to exert a horizontal force component against the roll, due to web tension. The roll bearings are each supported on a low friction slide, to permit substantially friction free displacement of the roll horizontally. The position of each roll bearing housing is controlled by an air bag acting as a variable rate spring to oppose displacement of the roll under web tension, with a second air bag opposed thereto, acting as a constant rate displacer, to assist the displacing effects of web tension. The two bearing housings are synchronized in their displacement under web tension variations by a synchronizing shaft extending across the width of the machine and connected with each of the two bearing housings by a rack and pinion arrangement. Rotation of the synchronizing shaft in response to a displacement of the spring roll due to a change in web tension produces a change in a potentiometer or other control device connected with the synchronizing shaft, which potentiometer is connected in speed controlling relation with the paper machine drive, to correct the speed of the machine so as to maintain substantially constant the tension in the web.

4 Claims, 2 Drawing Figures

FOLLOWER ROLL SUSPENSION SYSTEM

This invention is directed to a web tension control arrangement for use with a paper making machine, and in particular to a spring roll the position of which under the effects of web tension is controlled by a low friction positioning mechanism.

In the operation of paper machines and the like wherein the speed of the machine is controlled in response to the tension of the web being produced, so as to maintain web tension substantially constant, use is made of a variety of arrangements for sensing web tension.

One such prior arrangement has involved the use of a spring roll about which passes a reach of the web, so that the position of the roll under the influence of web tension forces is utilized to regulate the speed of the machine. The stability of operation of such prior arrangements has been adversely effected by friction forces acting on the suspension system of the roll. Where swing arms are used to support the roll the effects of gravity create a non-linear response.

In the present invention there is provided a low friction roll support arrangement wherein the displacement of the spring roll under variations in web tension is controlled by air springs that possess a low friction characteristic, with a variable rate air spring opposing the displacement of the roll, and a substantially constant rate spring maintaining the roll in pressing relation against the variable rate spring.

The mutually parallel position of the two end bearings of the spring roll is maintained by a synchronizing shaft, the ends of which carry gear pinions that mesh with rack portions of the respective gear housings. Rotation of the synchronizing shaft due to roll displacement in response to a variation in web tension is sensed by a potentiometer or other control device connected with the synchronizing shaft, which potentiometer is connected in speed-controlling relation with the machine drive, to vary the speed of the machine in a sense to restore web tension to a constant value.

The spring roll bearing flacks are supported by way of bushings slidably mounted on horizontally extending shafts, to avoid gravitational effects when the roll is displaced. By use of low friction bearings such as recirculating ball bearings the coefficient of friction of such support bushing arrangement can be maintained at an exceedingly low value. This, together with the low mass, low friction and low hysteresis characteristic of the air springs provides a spring roll arrangement of great fidelity, with low associated losses, high accuracy and little tendency to hunt.

Figure 1:
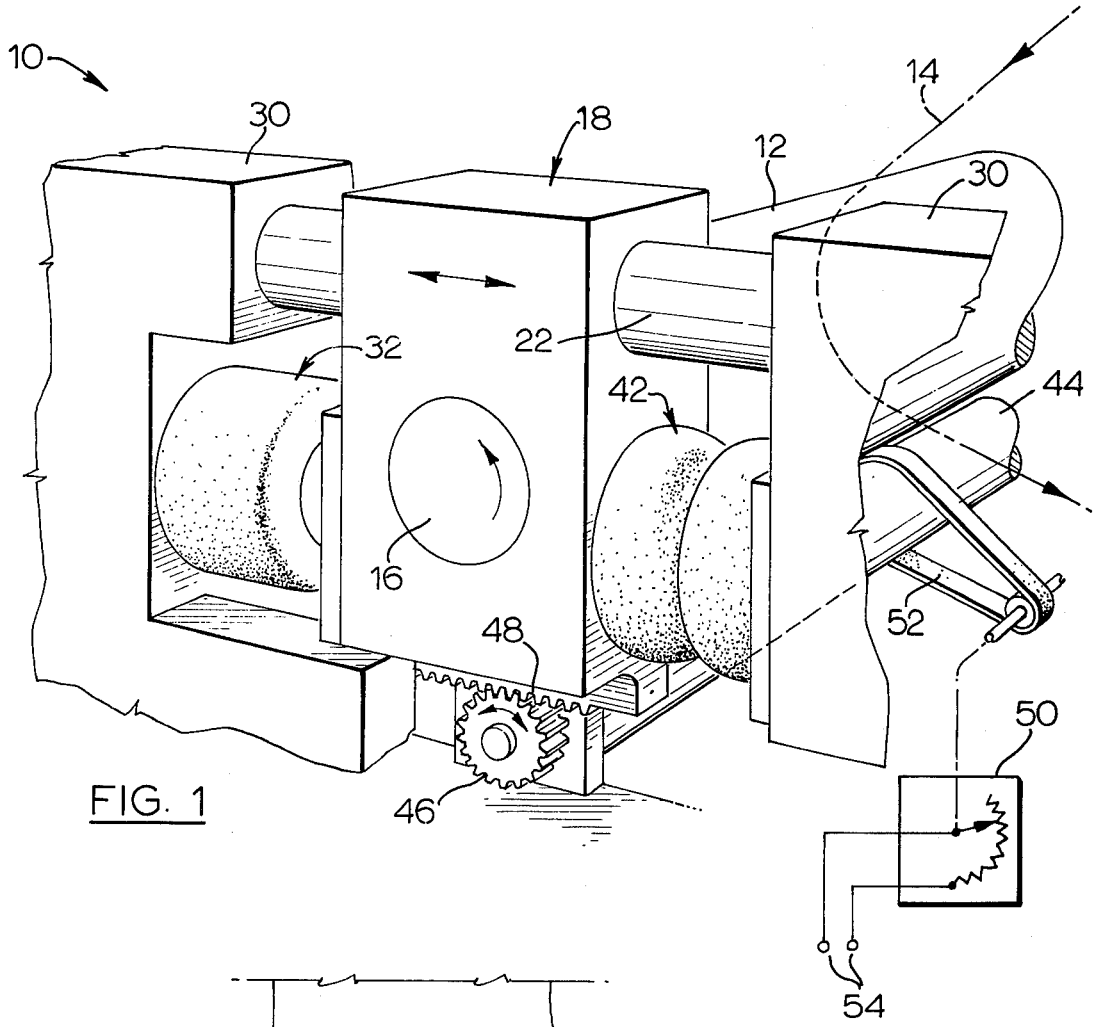
Figure 2:
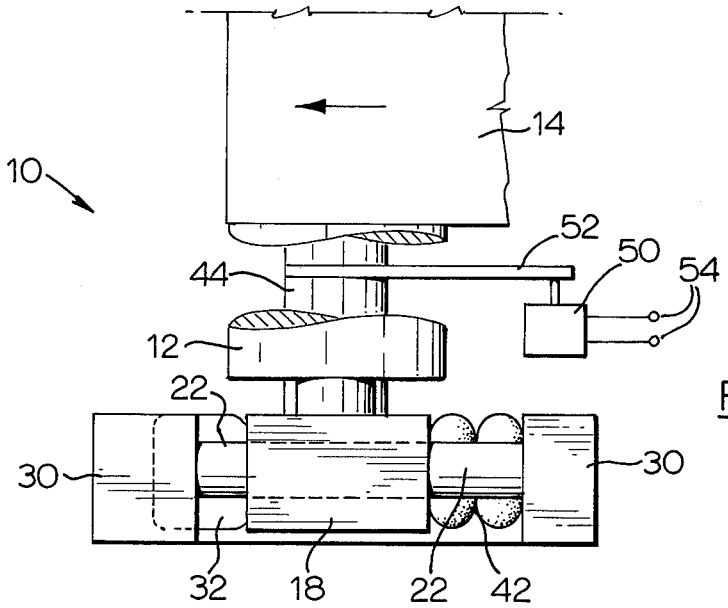

Certain embodiments of the present invention are described, reference being made to the accompaying drawings wherein;

FIG. 1 is a general view of a portion of a spring roll according to the present invention; and FIG. 2 is a plan view to reduced scale of the arrangement shown in FIG. 1.

In the illustrated embodiment 10 a roll 12 has a web 14 in wrapped engagement therewith and subtending an angle, as illustrated of about 90°.

The roll shafts are supported for rotation in a bearing housing 18, having a suspension shaft 22 extending through an upper portion thereof.

The bearing housing 18 is carried by the shaft 22 for sliding motion therealong, by means of a low friction support bearing, in this instance a recirculating ball sleeve, as is well known in the art and not specifically illustrated. A coefficient of friction as low as about 0.001 - 0.004 may thus be obtained.

The roll suspension assembly is located between a pair of pedestals 30 by means of opposed air bag springs. The illustrated left hand air spring 32 of known commercial type has a substantially uniform spring rate, to apply an almost constant force in the rightward direction to supplement the rightward tensile component forces from the web 14.

The illustrated right hand air bag spring 42 of known commercial type has a variable spring rate which increases as the spring 42 is compressed.

Thus it will be seen that the instantaneous location of the spring roll intermediate the pedestals 30 is a function of the spring characteristics and the web tension.

The roll 12 is maintained in parallel relation, i.e. having its longitudinal axis extending in the crossmachine direction, by means of a synchronizing shaft 44 extending between the two sides of the machine and connected with each bearing housing 18 by means of a pinion 46 keyed to the shaft 44 and engaging a rack portion 48 located on the lower side of the bearing housing 18. A feedback from the spring roll is provided, comprising in the illustrated arrangement a potentiometer 46 connected to the synchronizing shaft 44 by means of a belt 52, to provide a feed-back signal by way of connections 50 so as to regulate the paper machine drive in a sense to maintain web tension constant.

Thus, in operation, if web tension increases, to move the spring roll 12 to the right, with consequent clockwise rotation of the synchronizing shaft 44, the output from potentiometer 50 to the connections 54 connected with the paper machine drive operates in a speed reducing sense.

The reduction of machine speed, in response to the signal thus produced, reduces the tension in web 14, permitting the spring roll 12 to move leftwardly under the action of the air spring 42, to occupy its former position and provide stable speed regulation.

What I claim as new and desire to secure by Letters Patent of the United States is:

1. A spring roll system for a paper machine having a roll mounted between spaced bearing blocks for rotation therebetween when in use in web tensioning relation, roll support means comprising a pair of spaced horizontally extending shafts carrying low friction bearing means in supporting relation with said bearing blocks to permit in operation substantially linear horizontal displacement of the roll over a range of displacement in respsonse to a component of tension forces produced by a said web, closed air bag spring means to position said roll intermediately of said range of displacement, and means responsive to the relative position of said roll in said range of displacement connected in speed controlling relation with said paper machine to adjust the speed thereof in the sense to maintain the tension in said web constant.

2. The system as claimed in claim 1 including synchronizing shaft means mounted in interconnecting relation between said spaced bearing blocks, to maintain said roll in parallel relation with a further roll of said paper machine.

3. A spring roll system for a paper machine having a roll mounted between spaced bearing blocks for rotation therebetween when in use in paper web tensioning relation, roll support means comprising a pair of said horizontal shafts, extending in the direction of roll displacement, each having low friction bearings, in respective supporting relation with said bearing blocks to permit in operation substantially linear horizontal displacement of the roll over a range of displacement in response to a component of tension forces produced by said web, air bag spring means each comprising a first air spring of progressive rate and a second air spring of substantially constant rate acting in the direction of displacement in mutually opposed relation on opposite sides of each bearing block, to position said roll intermediately of said range of displacement, and means responsive to the relative position of said roll in said range of displacement connected in speed controlling relation with said paper machine to adjust the speed thereof in the sense to maintain the tension in said web constant.

4. The system as claimed in claim 3 including synchronizing shaft means mounted in interconnecting relation between said spaced bearing blocks, to maintain said roll in parallel relation with a transverse axis of said paper machine.

* * * * *